US011326321B2

(12) United States Patent
Barr

(10) Patent No.: US 11,326,321 B2
(45) Date of Patent: May 10, 2022

(54) HEIGHT-ADJUSTABLE FIXTURES FOR BURIED TUBULARS AND METHODS OF ADJUSTING THE HEIGHT-ADJUSTABLE FIXTURES

(71) Applicant: Barrco, Inc., Camas, WA (US)

(72) Inventor: Aaron Barr, Camas, WA (US)

( * ) Notice: Subject to any disclaimer, the term of this patent is extended or adjusted under 35 U.S.C. 154(b) by 0 days.

(21) Appl. No.: 17/171,871

(22) Filed: Feb. 9, 2021

(65) Prior Publication Data

US 2021/0270001 A1 Sep. 2, 2021

Related U.S. Application Data

(60) Provisional application No. 62/983,258, filed on Feb. 28, 2020.

(51) Int. Cl.

| | |
|---|---|
| ***E02D 29/14*** | (2006.01) |
| ***B66F 3/08*** | (2006.01) |
| ***A47B 91/02*** | (2006.01) |

(52) U.S. Cl.

CPC ..... *E02D 29/1409* (2013.01); *A47B 91/024* (2013.01); *B66F 3/08* (2013.01)

(58) Field of Classification Search

CPC ..... E02D 29/1409; B66F 3/08; A47B 91/024; A47B 91/022; A47B 2220/003; Y10T 16/182

USPC ..... 248/188.4; 16/19

See application file for complete search history.

(56) References Cited

U.S. PATENT DOCUMENTS

| | | | | |
|---|---|---|---|---|
| 2,272,848 A * | 2/1942 | Miller | A47B 91/024 16/19 |
| 2,366,401 A | 1/1945 | Haskell | |
| 2,930,295 A | 3/1960 | Hale | |
| 2,949,984 A * | 8/1960 | Daniels | E04B 2/821 52/126.7 |

(Continued)

FOREIGN PATENT DOCUMENTS

| | | |
|---|---|---|
| CH | 568450 A5 | 10/1975 |
| CN | 2883493 Y | 3/2007 |

(Continued)

OTHER PUBLICATIONS

Rimriser Adjustable Rolled Curb Frame & Grate (Year: 2021).*

(Continued)

*Primary Examiner* — Mahdi H Nejad
(74) *Attorney, Agent, or Firm* — Dascenzo Gates Intellectual Property Law, P.C.

(57) ABSTRACT

Height-adjustable fixtures for buried tubulars and methods of adjusting the height-adjustable fixtures. The height-adjustable fixtures include a frame and a plurality of slot nuts. The frame has an upper frame surface, a lower frame surface, a flange that defines a plurality of slots, and a central opening that extends between the upper frame surface and the lower frame surface. The central opening is sized to provide access to a buried tubular conduit of the buried tubular. Each slot nut is shaped to be received within a corresponding slot. In some examples, each slot nut defines a lower nut surface, an upper nut surface, and a neck region positioned between the lower nut surface and the upper nut surface. In some examples, when each slot nut is received within the corresponding slot, the lower nut surface is recessed within the corresponding slot.

29 Claims, 11 Drawing Sheets

(56) References Cited

U.S. PATENT DOCUMENTS

| | | | |
|---|---|---|---|
| 3,392,640 | A | 7/1968 | Zeile |
| 3,571,867 | A | 3/1971 | Cooke |
| 3,695,153 | A | 10/1972 | Dorris |
| 3,764,066 | A | 10/1973 | Kowell |
| 3,769,190 | A | 10/1973 | Deem, Jr. |
| 3,773,428 | A | 11/1973 | Bowman |
| 3,858,998 | A | 1/1975 | Larsson |
| 3,930,739 | A | 1/1976 | Larsson et al. |
| 4,281,944 | A | 8/1981 | Bowman |
| 4,544,302 | A | 10/1985 | Farrelly |
| 4,582,450 | A | 4/1986 | Neil |
| 4,618,464 | A | 10/1986 | Ditcher |
| 4,690,584 | A | 9/1987 | LeBaron |
| 4,867,600 | A | 9/1989 | Bowman |
| 4,913,582 | A | 4/1990 | Barrett |
| 4,925,337 | A | 5/1990 | Spiess et al. |
| 4,969,770 | A | 11/1990 | Bowman |
| 5,039,248 | A | 8/1991 | Bowman |
| 5,051,022 | A | 9/1991 | Bowman |
| 5,143,478 | A | 9/1992 | Bowman |
| 5,165,819 | A | 11/1992 | Bowman |
| 5,205,668 | A | 4/1993 | Adams |
| 5,211,504 | A | 5/1993 | Trudel |
| 5,221,155 | A | 7/1993 | Neil |
| 5,308,189 | A | 5/1994 | Claing |
| 5,318,376 | A | 6/1994 | Prescott |
| 5,326,188 | A | 7/1994 | Bowman |
| 5,451,119 | A | 9/1995 | Hondulas |
| 5,628,152 | A | 5/1997 | Bowman |
| 5,697,729 | A | 12/1997 | Bowman |
| 5,974,741 | A | 11/1999 | Fukuhara |
| 6,179,518 | B1 | 1/2001 | Suatac |
| 6,224,292 | B1 | 5/2001 | Akalin |
| 6,311,433 | B1 | 11/2001 | Zdroik |
| 6,350,093 | B1 | 2/2002 | Petersen et al. |
| 6,371,687 | B1 | 4/2002 | Heintz et al. |
| 6,682,258 | B2 | 1/2004 | McNeely |
| 6,811,350 | B2 | 11/2004 | Nadasde |
| 6,953,302 | B1 | 10/2005 | Kochling |
| 7,160,050 | B2 | 1/2007 | Meyers |
| 2002/0192023 | A1 | 12/2002 | McNeely |
| 2009/0241435 | A1 | 10/2009 | Suatac |
| 2020/0277776 | A1 | 9/2020 | Barr |

FOREIGN PATENT DOCUMENTS

| | | | |
|---|---|---|---|
| CN | 201232201 | Y | 5/2009 |
| CN | 202899167 | U | 4/2013 |
| DE | 2241222 | A1 | 3/1973 |
| DE | 4435498 | C2 | 1/1997 |
| DE | 3913291 | C2 | 4/1998 |
| DE | 29924904 | U1 | 10/2006 |
| DE | 102011007997 | A1 | 7/2012 |
| EP | 826834 | A2 | 3/1998 |
| EP | 953687 | A2 | 11/1999 |
| FR | 2900995 | A1 | 5/2006 |
| GB | 2527541 | B | 5/2019 |
| JP | H 0549888 | U | 7/1993 |
| JP | H 0581387 | U | 11/1993 |
| JP | H 0643 047 | U | 6/1994 |
| JP | 10072841 | A | 3/1998 |
| JP | H 1161964 | A | 3/1999 |
| JP | 11117340 | A | 4/1999 |
| JP | 2926542 | B2 | 5/1999 |
| JP | 2002294853 | A | 10/2002 |
| JP | 2006274652 | A | 10/2006 |
| JP | 3841666 | B2 | 11/2006 |
| JP | 3926769 | B2 | 3/2007 |
| JP | 4315843 | B2 | 8/2009 |
| JP | 2010222895 | A | 10/2010 |
| KR | 100560226 | B1 | 3/2006 |
| KR | 100936097 | B1 | 1/2010 |
| KR | 1020120016566 | A | 2/2012 |
| KR | 20160093956 | A | 8/2016 |
| KR | 1020170111850 | A | 10/2017 |
| WO | WO 2004085751 | A1 | 10/2004 |
| WO | WO 2016022316 | A1 | 2/2016 |

OTHER PUBLICATIONS

Rimriser Adjustable Municipal Casting Installation Guide (Year: 2020).*

Rimriser Adjustable 6.0" Manhole Ring & Cover (Year: 2021).*

English-language machine translation of Swiss Patent Application Publication No. CH 568450 A5, Oct. 31, 1975.

English-language machine translation of abstract of Chinese Patent No. CN 2883493 Y, Mar. 28, 2007.

English-language machine translation of abstract of Chinese Patent No. CN 201232201 Y, May 6, 2009.

English-language machine translation of abstract of Chinese Patent No. CN 202899167 U, Apr. 24, 2013.

English-language machine translation of description of German Patent Application Publication No. DE 2241222 A1, Mar. 1, 1973.

English-language machine translation of description of German Patent No. DE 3913291 C2, Apr. 9, 1998.

English-language machine translation of description of German Patent No. DE 4435498 C2, Jan. 30, 1997.

English-language machine translation of description of German Patent No. DE 29924904 U1, Oct. 12, 2006.

English-language machine translation of description of European Patent Application Publication No. EP 826834 A2, Mar. 4, 1998.

English-language machine translation of description of European Patent Application Publication No. EP 953687 A2, Nov. 3, 1999.

English-language machine translation of description of Japanese Patent No. JP 3841666 B2, Nov. 1, 2006.

English-language machine translation of abstract of Japanese Patent No. JP 4315843 B2, Aug. 9, 2009.

English-language machine translation of abstract of Japanese Patent No. JP 4315843 B2, May 29, 2009.

English-language machine translation of abstract of Japanese Patent Application Publication No. JP 2002294853 A, Oct. 9, 2002.

English-language machine translation of abstract of Japanese Patent Application Publication No. JP 2006274652 A, Oct. 12, 2006.

English-language machine translation of abstract of Japanese Patent Application Publication No. JP 2010222895 A, Oct. 7, 2010.

English-language machine translation of description of Japanese Patent Application Publication No. JPH 0549888 U, Jul. 2, 1993.

English-language machine translation of description of Japanese Patent Application Publication No. JPH 0581387 U, Nov. 5, 1993.

English-language machine translation of description of Japanese Patent Application Publication No. JPH 0643 047 U, Jun. 7, 1994.

English-language machine translation of description of Japanese Patent No. JPH 1161964 A, Mar. 5, 1999.

English-language machine translation of description of Korean Patent No. KR 100936097 B1, Jan. 11, 2010.

English-language machine translation of description of Korean Patent Application Publication No. KR 20160093956 A, Aug. 9, 2016.

Mirae Industry height adjustable basin product: www.ebay.com/itm/MIRAE-INDUSTRY-Height-adjustable-catch-basin-M-44, available at least as early as Jun. 21, 2018.

English-language machine translation of abstract of Japanese Patent No. JP 2926542 B2, May 15, 1999.

English-language machine translation of abstract of Japanese Patent No. JP 3926769 B2, Mar. 9, 2007.

English-language machine translation of Japanese Patent Application Publication No. JP 10072841 A, Mar. 17, 1998.

English-language machine translation of Japanese Patent Application Publication No. JP 11117340 A, Apr. 27, 1999.

English-language machine translation of Korean Patent No. KR 100560226 B1, Mar. 6, 2006.

English-language machine translation of Korean Patent Application Publication No. KR 1020120016566 A, Feb. 24, 2012.

English-language machine translation of Korean Patent Application Publication No. KR 1020170111850 A, Oct. 12, 2017.

(56) References Cited

OTHER PUBLICATIONS

3D24 tapered T-slot nut product: https://www.3d24.eu/T-Slot-Nut-Sliding-Block-Slot-8-Type-B-with-step-heavy-duty-steel, available at least as early as Feb. 22, 2015.
FK Automotive tapered lug nut product: https://www.fk-shop.de/en/Wheel-Spacers/Wheel-bolts/Single-wheel-nut-length-34mm-conical-collar-M12x1-75-silver.html, available at least as early as Mar. 17, 2016.
MidFix wedge nut product: https://www.midfix.co.uk/product/wedge-nuts-mini-mini/, available at least as early as May 16, 2018.
English-language machine translation of French Patent Application Publication No. FR 2900995 A1, May 15, 2006.

* cited by examiner

HEIGHT-ADJUSTABLE FIXTURES FOR BURIED TUBULARS AND METHODS OF ADJUSTING THE HEIGHT-ADJUSTABLE FIXTURES

RELATED APPLICATION

This application claims priority to U.S. Provisional Patent Application No. 62/983,258, which was filed on Feb. 28, 2020, and the complete disclosure of which is hereby incorporated by reference.

FIELD OF THE DISCLOSURE

The present disclosure relates generally to height-adjustable fixtures for buried tubulars and/or to methods of adjusting the height-adjustable fixtures.

BACKGROUND OF THE DISCLOSURE

Buried tubulars may be utilized to define storm drain systems, sewer systems, utility passageways, and/or other underground infrastructure within a subsurface region. Generally, the buried tubulars are installed via excavation and/or trenching and subsequent backfill. However, in some examples, the buried tubulars may be installed via subsurface drilling and/or boring. A fixture, such as a catch basin frame and/or a manhole cover frame, may be installed at an interface between the buried tubulars and a surface region. Such fixtures may be utilized to limit access to the buried tubulars and/or to permit stormwater to enter the buried tubulars. As an example, a storm grate may be installed within the catch basin frame to permit and/or facilitate the flow of storm water into a stormwater system while, at the same time, restricting the flow of debris and/or entry of unauthorized personnel into the stormwater system. As another example, a manhole cover may be installed within a manhole cover frame to limit access to the buried tubular.

During construction of the underground infrastructure, fixtures may be positioned, or set, and connected to the buried tubulars. The ground level then may be brought up to an initial grade, and a portion of the fixtures may extend above the initial grade. Subsequently, often many months later, the ground level may be brought up to a final grade, and the original positioning of the fixtures is such that a top surface of the fixtures is level with the final grade.

In practice, a variety of factors may influence the accuracy with which the top surface of the fixtures matches the final grade. As an example, the initial positioning of the fixtures may be incorrect. As another example, the fixtures may be impacted and/or otherwise shifted via contact with surface equipment, such as construction machinery, prior to the ground level being brought up to final grade. As yet another example, soil compaction or displacement may cause the fixtures to settle, thus moving them from their original position.

Because of these, and other, factors, it is common to adjust the position of the fixtures prior to establishing the final grade. Historically, this adjustment has been accomplished by lifting, lowering, and/or rotating the entire fixture. If the adjustments are significant, it may be necessary to excavate an entirety of the fixture and/or to reposition the buried tubular that is connected to the fixture. While this approach is effective, it also is extremely time-consuming, it is expensive, and there is a risk of injury to personnel who perform the adjustments. Thus, there exists a need for improved height-adjustable fixtures for buried tubulars and/or for methods of adjusting the height-adjustable fixtures.

SUMMARY OF THE DISCLOSURE

Height-adjustable fixtures for buried tubulars and methods of adjusting the height-adjustable fixtures. The height-adjustable fixtures include a frame and a plurality of slot nuts. The frame has an upper frame surface and a lower frame surface. The frame also includes a flange that defines a plurality of slots and a central opening that extends between the upper frame surface and the lower frame surface. The central opening is sized to provide access to a buried tubular conduit that is defined by the buried tubular. Each slot nut of the plurality of slot nuts is shaped to be received within a corresponding slot of the plurality of slots.

In some examples, each slot nut defines a lower nut surface, an upper nut surface, and a neck region positioned between the lower nut surface and the upper nut surface. In some such examples, and when each slot nut is received within the corresponding slot, a region of the frame that defines the corresponding slot extends into the neck region. In some examples, when each slot nut is received within the corresponding slot, the lower nut surface is recessed within the corresponding slot relative to the lower frame surface of the frame.

The methods include positioning at least one slot nut of the plurality of slot nuts within the corresponding slot of the plurality of slots while the lower frame surface is physically supported by an upper tubular surface of the buried tubular. The methods also include rotating a corresponding jack screw, which is received within a corresponding jack-screw-accepting threaded region of the at least one slot nut of the plurality of slot nuts, such that the corresponding jack screw engages the buried tubular and adjusts an orientation of the height-adjustable fixture relative to the buried tubular.

DETAILED DESCRIPTION AND BEST MODE OF THE DISCLOSURE

Figure 1:
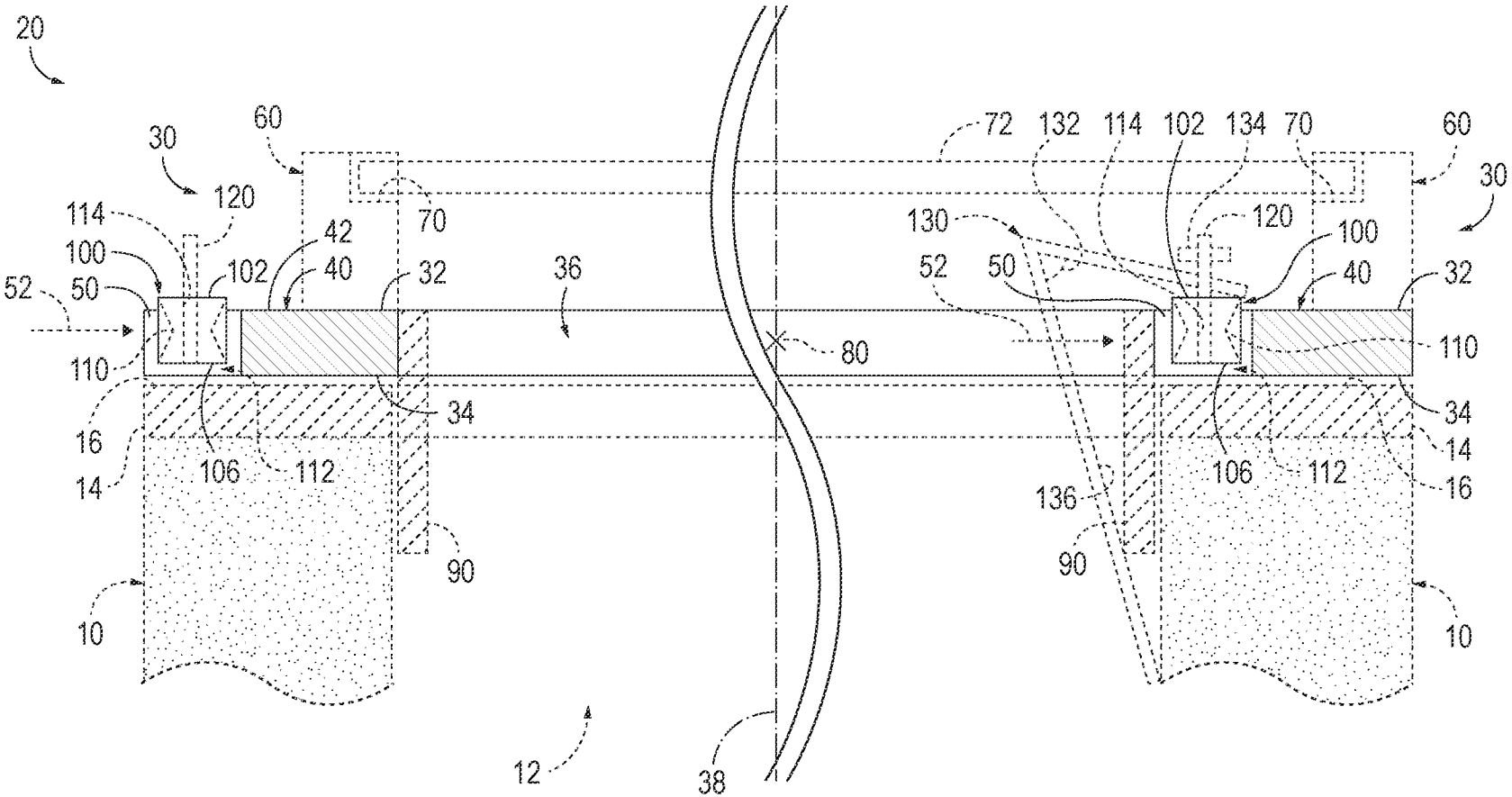
FIG. 1 is a schematic illustration of examples of height-adjustable fixtures according to the present disclosure.
Figure 2:
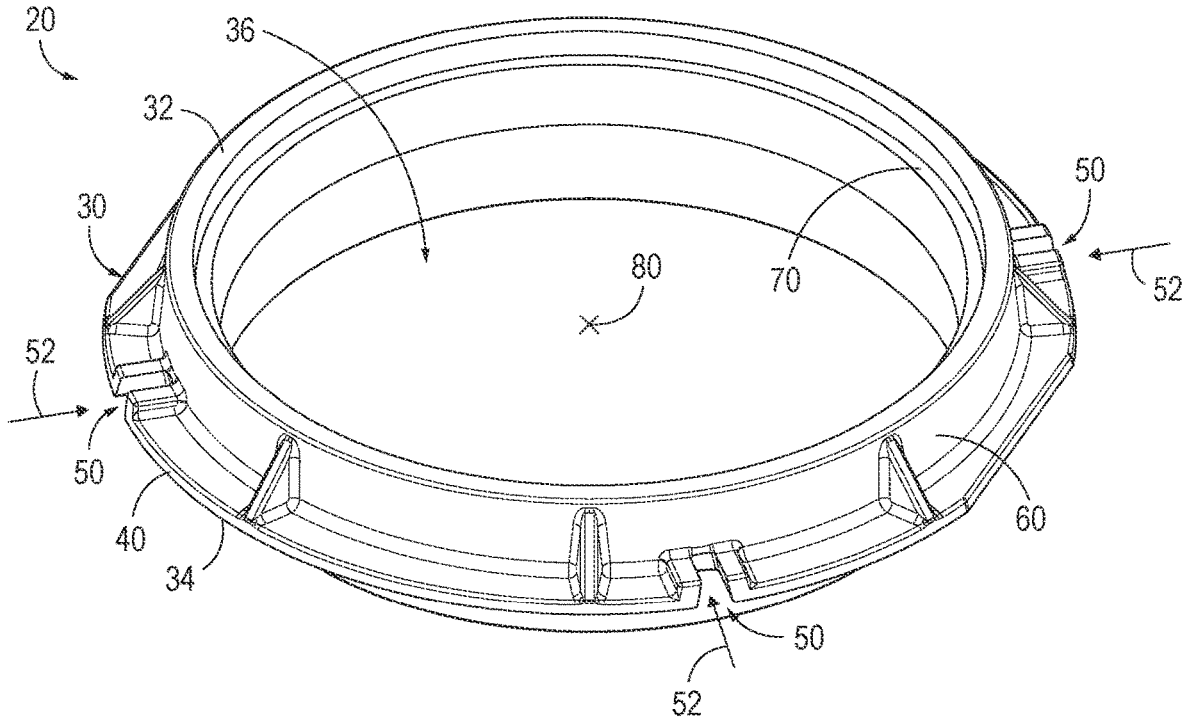
FIG. 2 is a less schematic isometric view illustrating an example of a frame of a height-adjustable fixture, according to the present disclosure.
Figure 3:
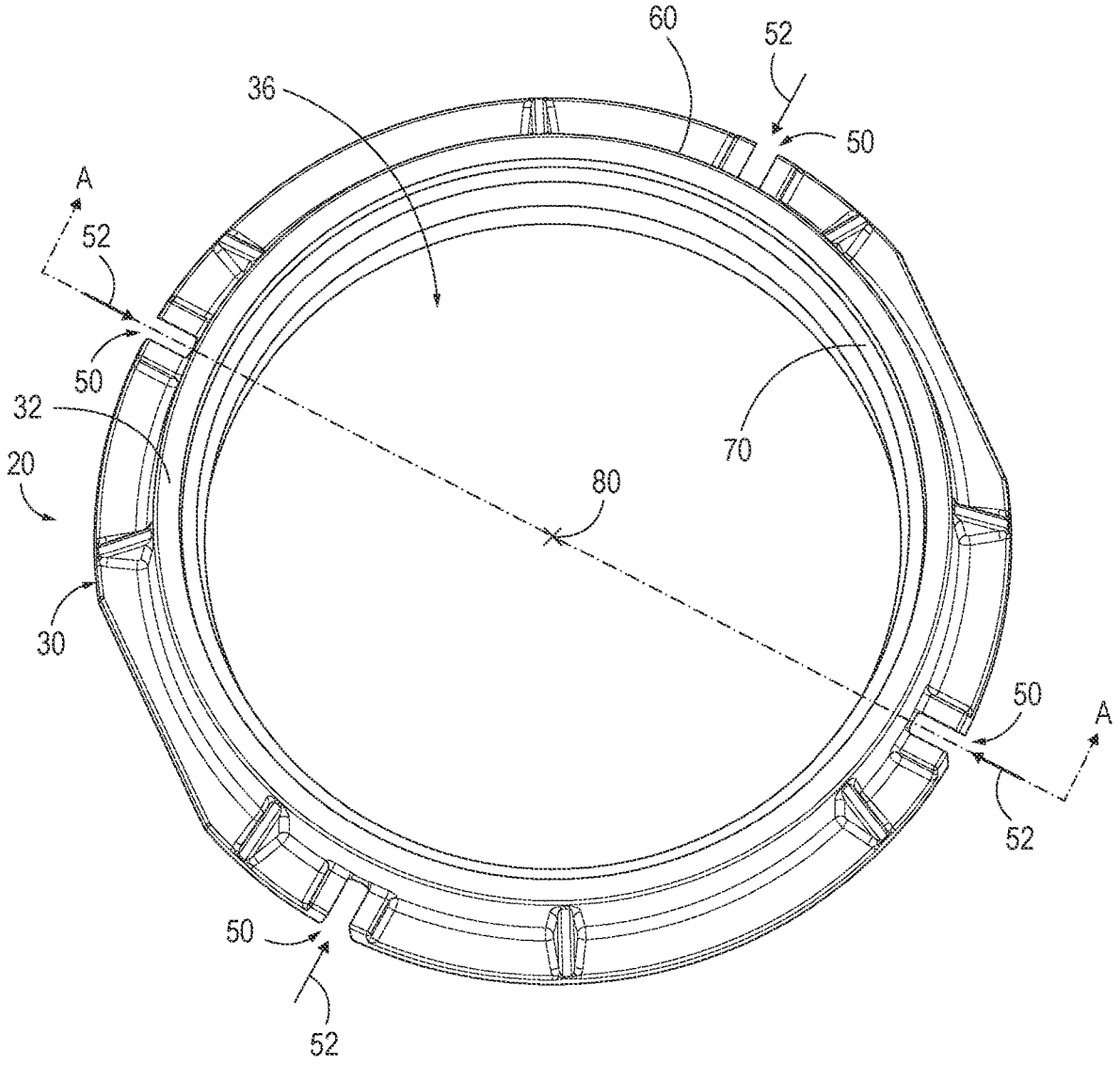
FIG. 3 is a top view of the frame of FIG. 2.
Figure 4:
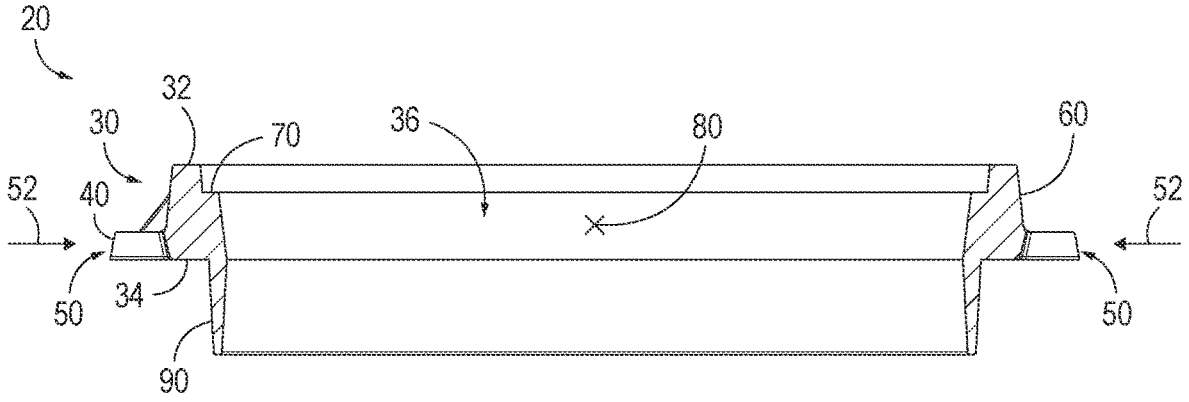
FIG. 4 is a cross-sectional view of the frame of FIGS. 2-3 taken along line A-A of FIG. 3.

FIGS. 1-22 provide examples of height-adjustable fixtures 20 and/or illustrate steps of methods according to the present disclosure. Elements that serve a similar, or at least substantially similar, purpose are labeled with like numbers in each of FIGS. 1-22, and these elements may not be discussed in detail herein with reference to each of FIGS. 1-22. Similarly, all elements may not be labeled in each of FIGS. 1-22, but reference numerals associated therewith may be utilized herein for consistency. Elements, components, and/or features that are discussed herein with reference to one or more of FIGS. 1-22 may be included in and/or utilized with any of FIGS. 1-22 without departing from the scope of the present disclosure.

In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

Figure 18:
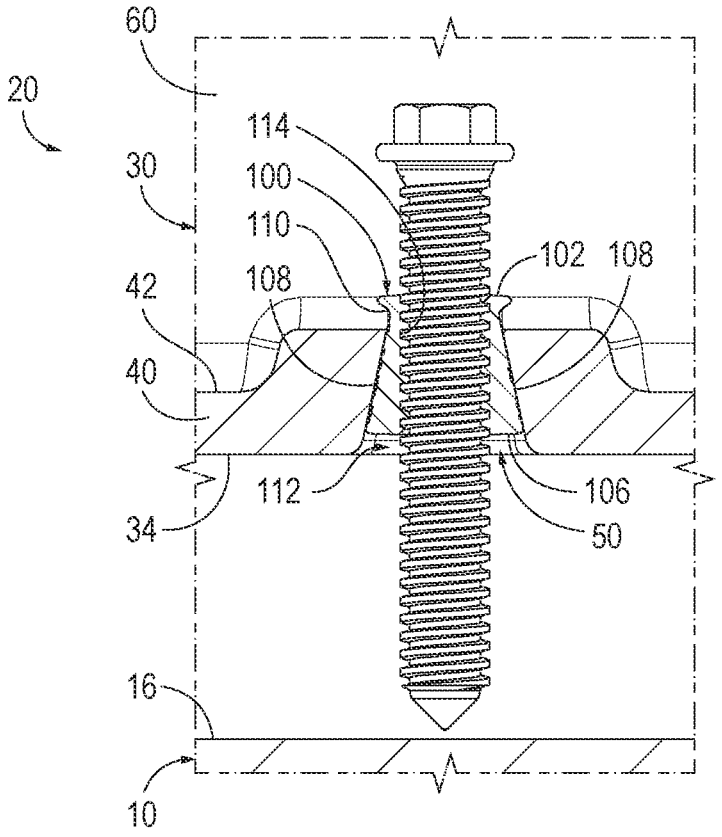
FIG. 18 is a more detailed side view illustrating a slot nut received within a slot of the height-adjustable fixture of FIGS. 15-17.
Figure 19:
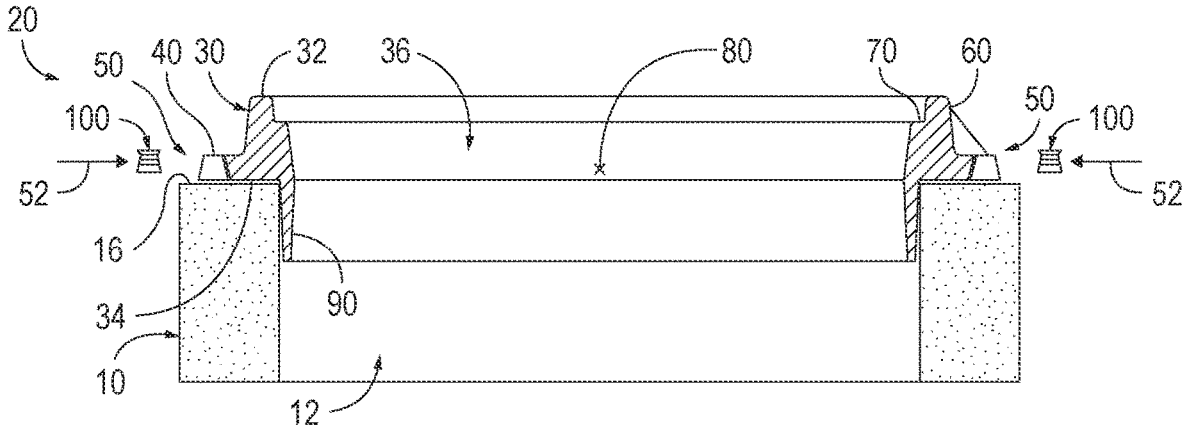
FIG. 19 is a schematic cross-sectional view illustrating an example of a frame of a height-adjustable fixture supported by an upper tubular surface of a buried tubular, according to the present disclosure.
Figure 20:
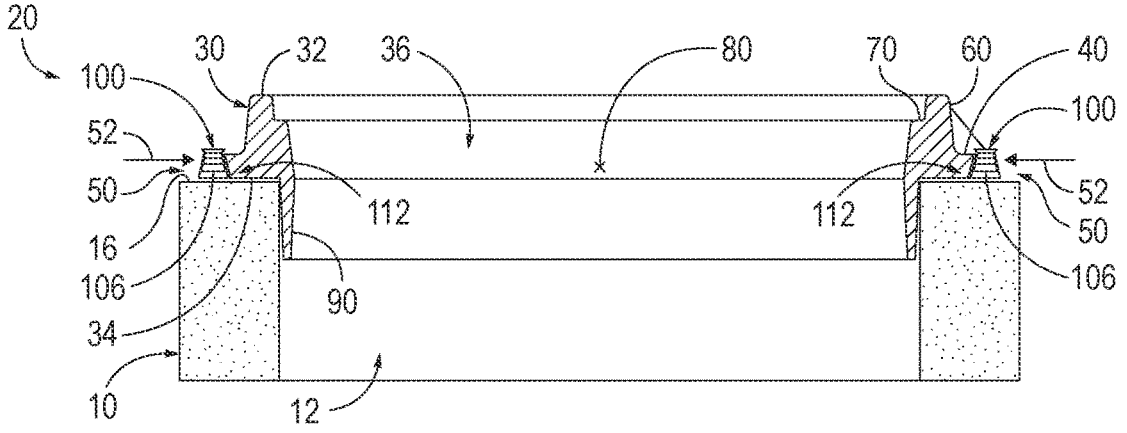
FIG. 20 is a schematic cross-sectional view illustrating the frame of FIG. 19 with slot nuts received within corresponding slots to form a height-adjustable fixture, according to the present disclosure.
Figure 21:
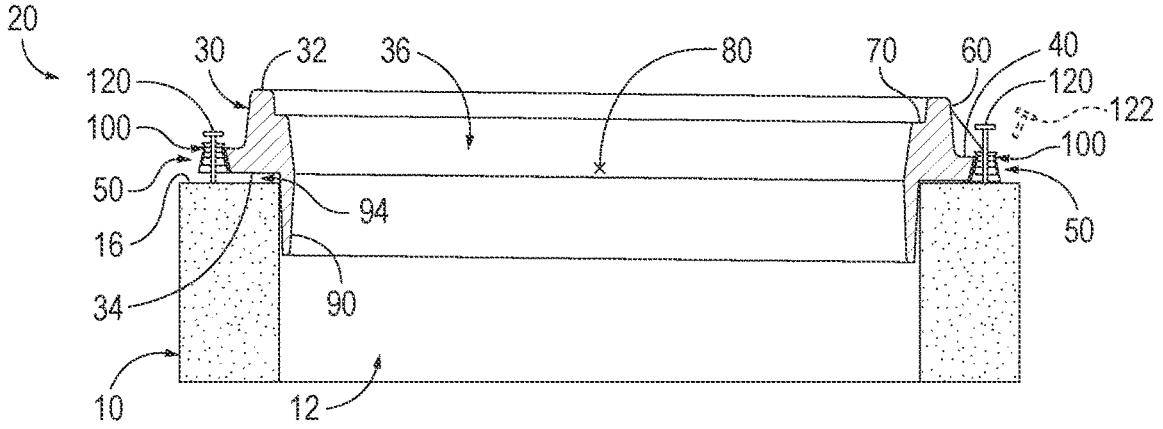
FIG. 21 is a schematic cross-sectional view illustrating adjustment of an orientation of the height-adjustable fixture of FIGS. 19-20.

FIG. 1 is a schematic illustration of examples of height-adjustable fixtures 20 according to the present disclosure. FIGS. 2-7 are less schematic views illustrating an example of a frame 30 of height-adjustable fixtures 20, according to the present disclosure. FIGS. 8-14 are less schematic views illustrating an example of a slot nut 100 of height-adjustable fixtures 20, according to the present disclosure. FIGS. 15-18 are less schematic views illustrating an example of height-adjustable fixtures 20, according to the present disclosure. FIGS. 19-21 are less schematic cross-sectional views illustrating additional examples of frame 30 of height-adjustable fixture 20 supported by an upper tubular surface 16 of a buried tubular 10, according to the present disclosure. Height-adjustable fixtures 20 also may be referred to herein as fixtures 20.

As illustrated schematically in FIG. 1 and less schematically in FIGS. 15-21, height-adjustable fixtures 20 may be configured to be supported by upper tubular surface 16 of buried tubular 10. As also illustrated, buried tubular 10 may define a buried tubular conduit 12.

As illustrated collectively by FIGS. 1-21, height-adjustable fixtures 20 include frame 30 and a plurality of slot nuts 100. Frame 30 has and/or defines an upper frame surface 32, a lower frame surface 34, and a central opening 36 that extends between the upper frame surface and the lower frame surface. Central opening 36 may be sized to permit, to facilitate, and/or to provide access to buried tubular conduit 12. Frame 30 also includes a flange 40 that defines a plurality of slots 50. Each slot nut 100 is shaped to be received within a corresponding slot 50.

Figure 22:
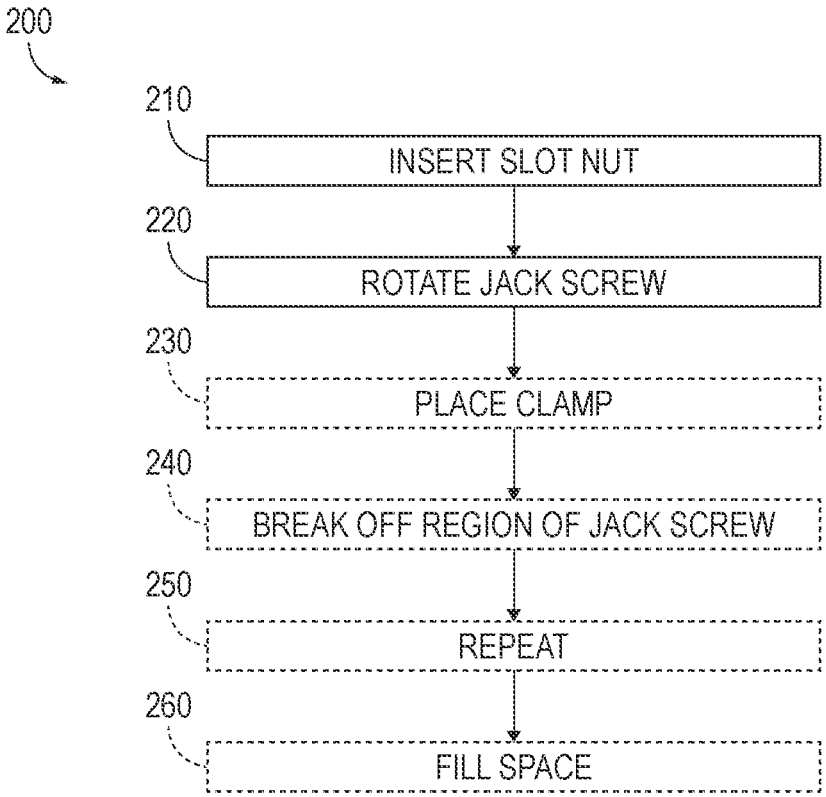
FIG. 22 is a flowchart illustrating examples of methods of adjusting a height-adjustable fixture, according to the present disclosure.

During utilization and/or adjustment of height-adjustable fixtures 20, and as illustrated in FIGS. 1 and 19 and discussed in more detail herein with reference to methods 200 of FIG. 22, frame 30 may be positioned on upper tubular surface 16 of buried tubular 10. This may include positioning frame 30 such that lower frame surface 34 faces toward upper tubular surface 16 and/or such that frame 30 and/or lower frame surface 34 thereof is directly supported, indirectly supported, physically supported, and/or operatively supported by upper tubular surface 16.

One or more slot nuts 100 may, or subsequently may, be inserted within corresponding slots 50, such as by operatively translating slot nuts 100 along corresponding insertion trajectories 52, as illustrated by the transition from the configuration illustrated in FIG. 19 to the configuration illustrated in FIG. 20. As discussed in more detail herein, slot nuts 100 may be configured to permit and/or to facilitate insertion of each slot nut 100 into a corresponding slot while frame 30 is supported by buried tubular 10. As an example, and as also discussed in more detail herein, a gap 112 may separate a lower nut surface 106 of slot nuts 100 from upper tubular surface 16 of buried tubular 10, thereby permitting and/or facilitating the insertion of each slot nut 100 into corresponding slot 50. Stated another way, gap 112 may be established and/or defined when and/or as slot nut 100 is inserted within corresponding slot 50. Stated yet another way, lower nut surface 106 of slot nut 100 may be recessed and/or elevated within corresponding slot 50 relative to lower frame surface 34 of frame 30. The presence of gap 112 and/or the relative orientation between lower nut surface 106 and lower frame surface 34 may permit the slot nut to be inserted (and repositioned) within the corresponding slot while frame 30 is positioned on buried tubular 10. Such a configuration may decrease a potential for loss of, damage to, and/or fouling of slot nuts 100 during positioning of frame 30 on and/or relative to buried tubular 10.

As illustrated in FIG. 21, a corresponding jack screw 120, which may be received within a corresponding jack-screw-accepting threaded region of at least one slot nut 100, may be rotated. This rotation may cause the jack screw to engage, or to engage with, upper tubular surface 16, thereby urging a region of frame 30 away from a corresponding region of buried tubular 10 and/or adjusting an orientation of height-adjustable fixture 20 relative to buried tubular 10.

In some examples, and as illustrated in dashed lines in FIG. 1, a base plate 14 may define a portion of buried tubular 10 and/or may extend between height-adjustable fixture 20 and a remainder of buried tubular 10. Base plate 14, when present, may be formed from a metal, such as steel and/or cast iron, while the remainder of buried tubular 10 may be formed from concrete. As such, inclusion of base plate 14 may decrease a potential for damage to the buried tubular when jack screw 120 engages the buried tubular. Base plate 14 also may be referred to herein as a jack plate 14 and/or as a spalling plate 14.

Height-adjustable fixtures 20 according to the present disclosure may provide several distinct benefits over conventional fixtures for buried tubulars. As an example, adjustment of the height of fixtures 20 via rotation of jack screws 120 may be much faster, and easier to perform, when compared to adjustment of the height of conventional fixtures, thereby decreasing overall time and cost needed to perform an adjustment. As another example, adjustment of the height of fixtures 20 via rotation of jack screws 120 may be significantly more precise when compared to prior art methods that rely upon digging up the fixture, repositioning the fixture, potentially shimming the fixture, etc. As yet another example, adjustment of the height of fixtures 20 via rotation of jack screws 120 may be significantly safer for workers when compared to adjustment of conventional fixtures.

Frame 30 may include and/or be any suitable structure that may have and/or define upper frame surface 32, lower frame surface 34, central opening 36, flange 40, and/or slots 50. In addition, frame 30 may be formed and/or defined from any suitable material and/or materials. As an example, frame 30 may include and/or be a metallic frame, a cast iron frame, a plastic frame, and an aluminum frame. As another example, frame 30 may be formed and/or defined by a monolithic frame body and/or by a unitary frame body.

Flange 40 may include and/or be any suitable structure that may form and/or define slots 50. As examples, flange 40 may extend parallel, or at least substantially parallel, to lower frame surface 34, flange 40 may define, or at least partially define, lower frame surface 34, and/or flange 40 may define, or at least partially define, central opening 36. In some examples, flange 40 may extend away from central opening 36, as illustrated on the left side of FIG. 1 and in FIGS. 2-5, 15, and 19-21. In some examples, flange 40 may extend into central opening 36 and/or may at least partially define central opening 36, as illustrated on the right side of FIG. 1.

In some examples, and as illustrated in dashed lines in FIG. 1 and in solid lines in FIGS. 2-7 and 15-21, frame 30 may include a rim 60. Rim 60, when present, may extend away from flange 40. As an example, rim 60 may extend perpendicular, or at least substantially perpendicular, to flange 40 and/or to lower frame surface 34. In some examples, rim 60 may define, or at least partially define, upper frame surface 32.

Figure 15:
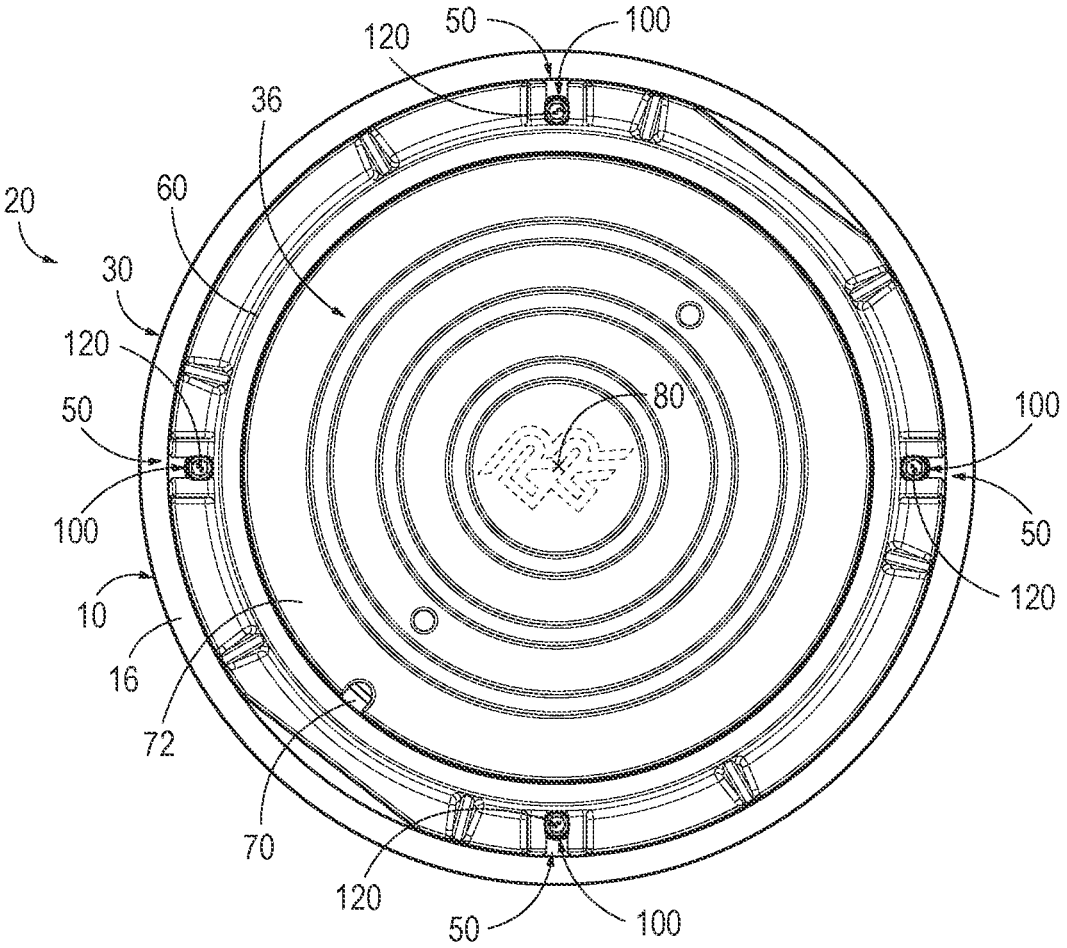
FIG. 15 is a less schematic top view illustrating an example of a height-adjustable fixture according to the present disclosure.
Figure 16:
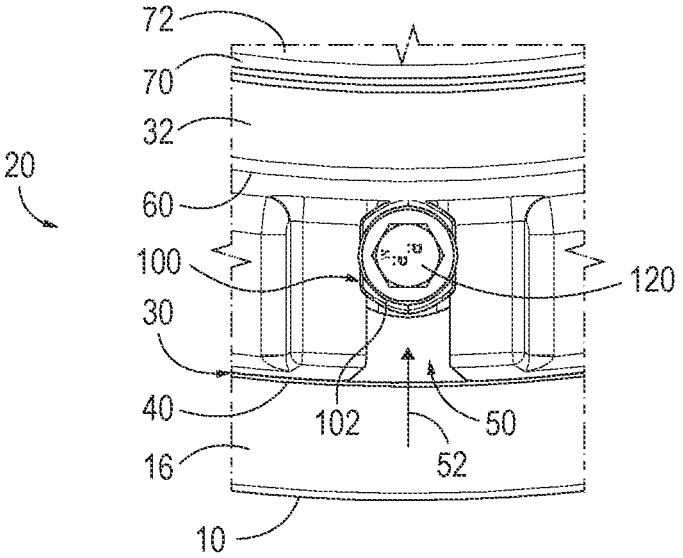
FIG. 16 is a detailed top view illustrating a slot nut received within a slot of the height-adjustable fixture of FIG. 15.
Figure 17:
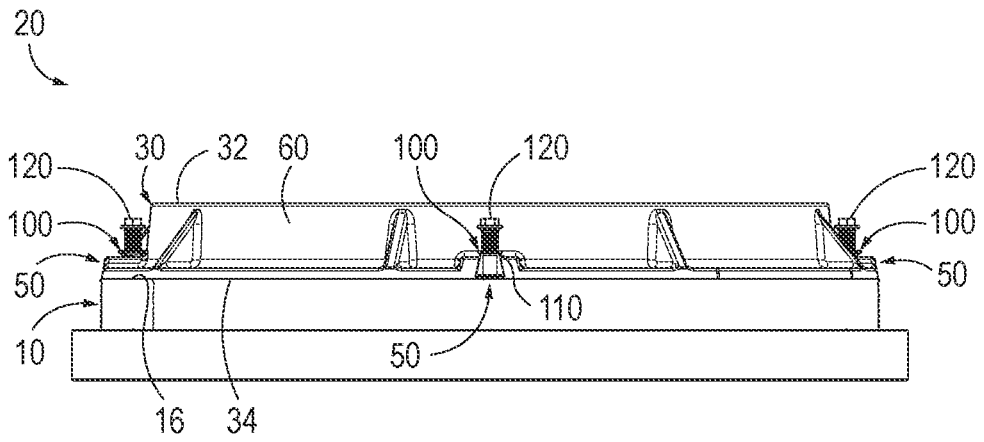
FIG. 17 is a side view of the height-adjustable fixture of FIGS. 15-16.

In some examples, and as illustrated in dashed lines in FIG. 1 and in solid lines in FIGS. 2-4, 6, 15-16, and 19-21, frame 30 includes a support lip 70. Support lip 70, when present, may be configured to support a cover 72, as illustrated in FIGS. 1 and 15-16. Cover 72, when present, may be configured to restrict, or to selectively restrict, access to central opening 36 and/or access to buried tubular conduit 12 via central opening 36. This may include restriction of access to the central opening from above and/or from an upper frame surface-facing side of height-adjustable fixture 20.

Figure 5:
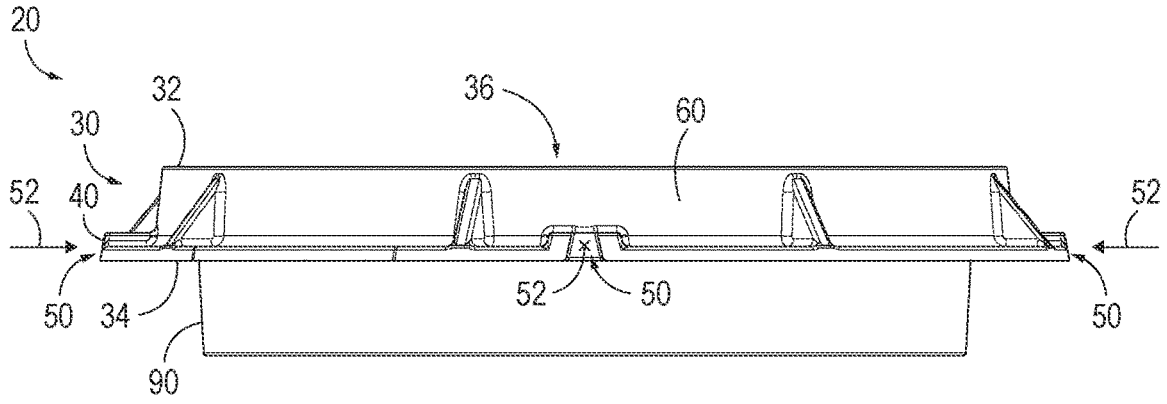
FIG. 5 is a side view of the frame of FIGS. 2-4.
Figure 6:
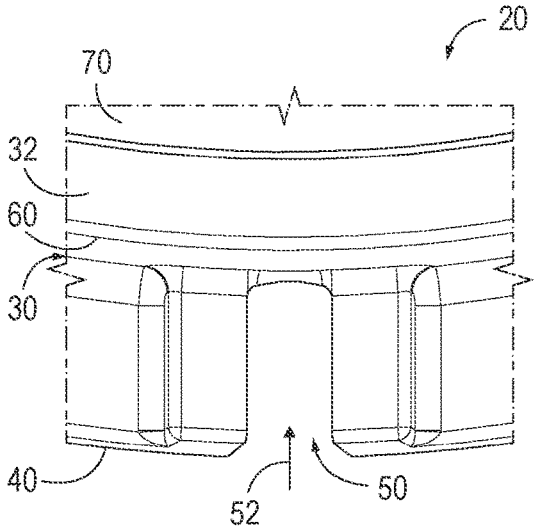
FIG. 6 is a more detailed top view illustrating an example of a slot that is defined by the frame of FIGS. 2-5.
Figure 7:
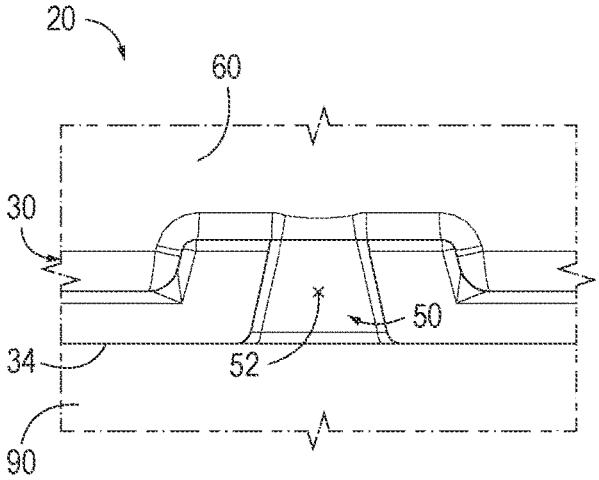
FIG. 7 is a more detailed side view illustrating the slot of FIG. 6.
Figure 8:
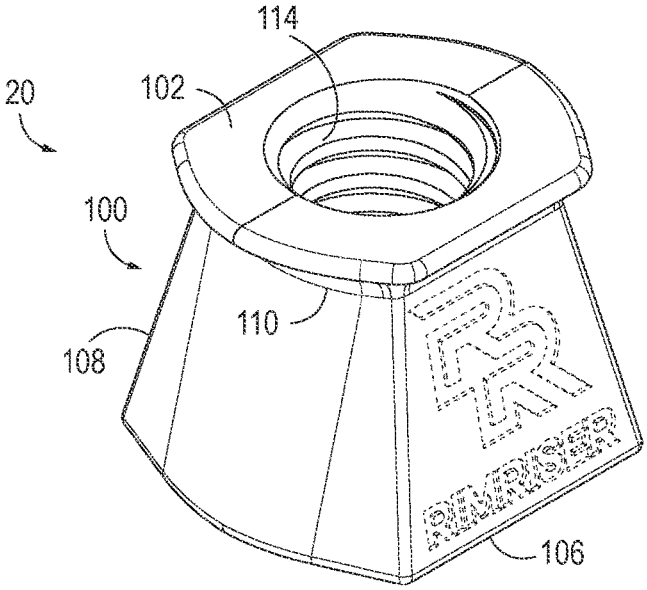
FIG. 8 is a less schematic profile view illustrating an example of a slot nut of a height-adjustable fixture, according to the present disclosure.
Figure 9:
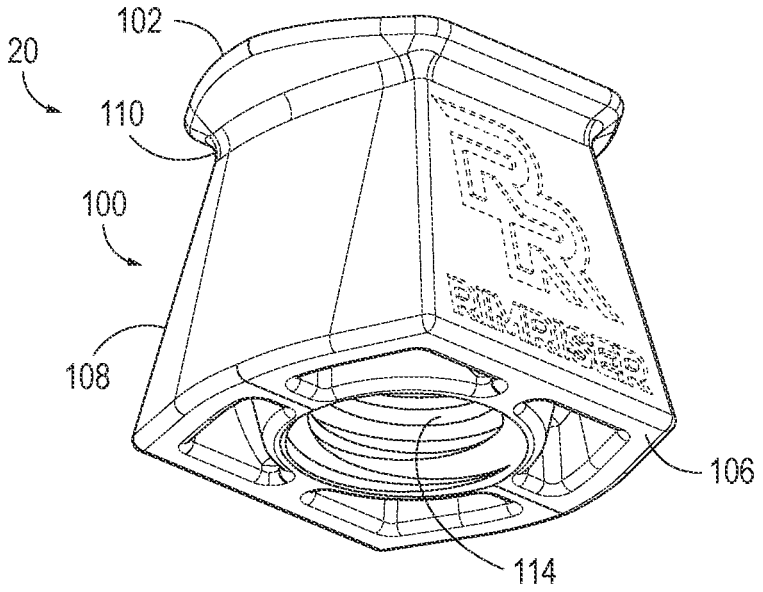
FIG. 9 is another profile view of the slot nut of FIG. 8.
Figure 10:
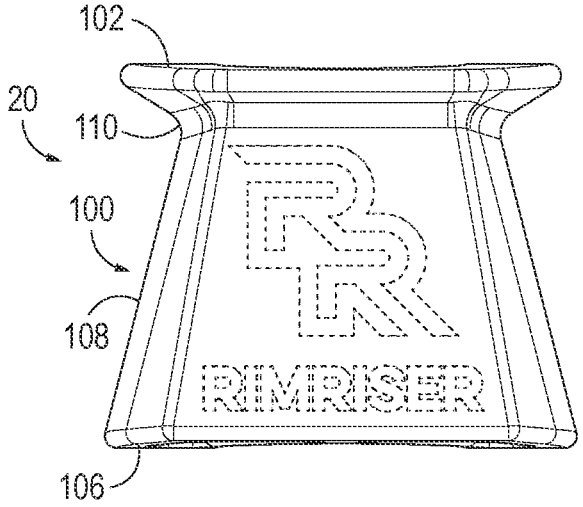
FIG. 10 is a side view of the slot nut of FIGS. 8-9.
Figure 11:
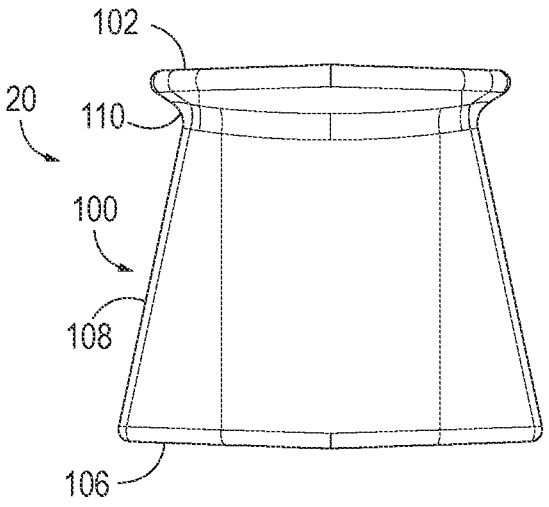
FIG. 11 is another side view of the slot nut of FIGS. 8-10.
Figure 12:
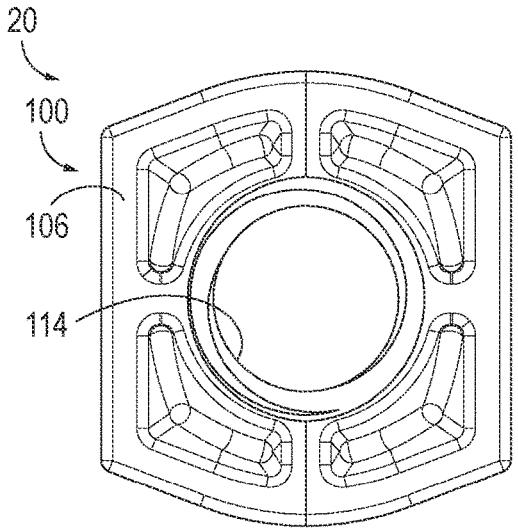
FIG. 12 is a bottom view of the slot nut of FIGS. 8-11.
Figure 13:
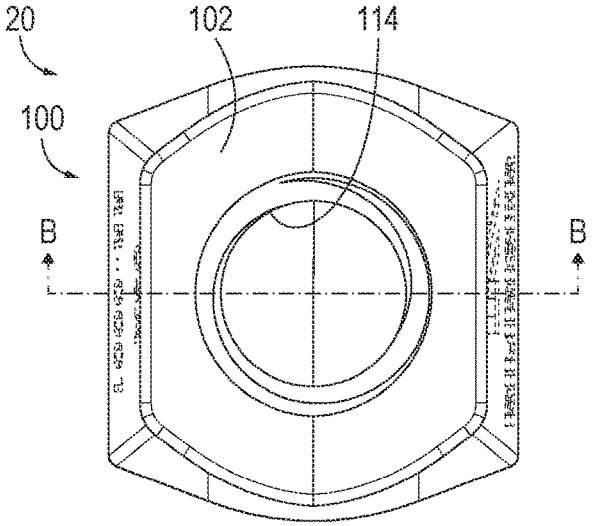
FIG. 13 is a top view of the slot nut of FIGS. 8-12.
Figure 14:
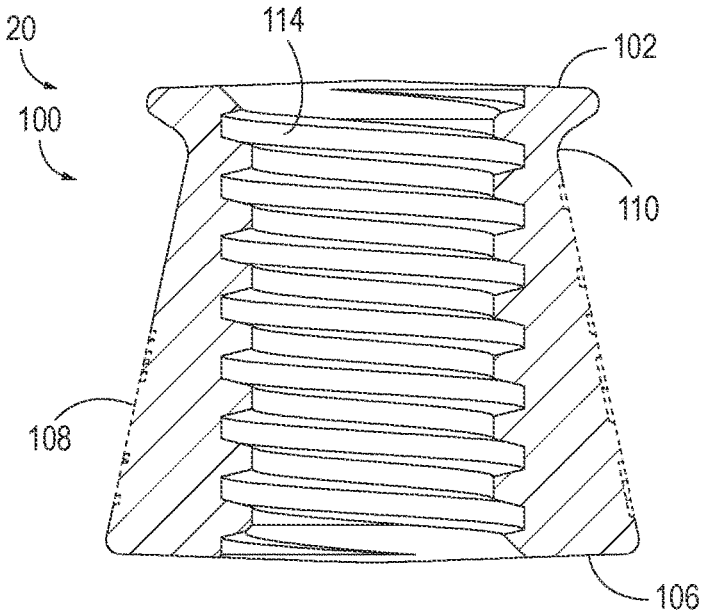
FIG. 14 is a cross-sectional view of the slot nut of FIGS. 8-13 taken along line B-B of FIG. 13.

Slots 50 may be defined by flange 40 in any suitable manner and/or may have and/or define any suitable shape that receives, or that is configured to receive, slot nuts 100. As an example, and as discussed in more detail herein, slots 50 may have a shape that corresponds to, or that corresponds to an external surface contour of, slot nuts 100. As a specific example, and as illustrated in FIGS. 5 and 7, slots 50 may taper away from lower frame surface 34 and/or may become smaller, or may define a smaller transverse cross-sectional area, as the slots progress away from lower frame surface 34. Such a configuration may permit and/or facilitate retention of slot nuts 100 within slot 50, as discussed in more detail herein.

In addition, slots 50 may extend in any suitable direction. As an example, slots 50 may extend radially from a central point 80, as illustrated in FIGS. 1-4, 15, and 19-21. As another example, slots 50 may extend away from central opening 36 and/or may open away from the central opening, as illustrated on the left side of FIG. 1 and in FIGS. 2-4, 15, and 19-21. As yet another example, slots 50 may extend toward, may extend into, and/or may open into central opening 36, as illustrated on the right side of FIG. 1. As illustrated on the left side of FIG. 1, when slots 50 extend away from central opening 36, insertion trajectory 52 may be directed toward central opening 36 and/or toward central point 80. Alternatively, as illustrated on the right side of FIG. 1, when slots 50 extend into central opening 36, insertion trajectory 52 may be directed away from central opening 36 and/or away from central point 80.

Central opening 36 may have and/or define any suitable shape that may extend between upper frame surface 32 and lower frame surface 34 and/or that may be bounded, or circumferentially bounded, by frame 30. As an example, central opening 36 may have a circular transverse cross-sectional shape, an at least substantially circular transverse cross-sectional shape, and/or an at least partially circular transverse cross-sectional shape. As another example, central opening 36 may be cylindrical, at least substantially cylindrical, and/or at least partially cylindrical. As yet another example, central opening 36 may have a rectangular transverse cross-sectional shape, an at least substantially rectangular transverse cross-sectional shape, and/or an at least partially rectangular transverse cross-sectional shape. As another example, central opening 36 may have a squircular transverse cross-sectional shape, an at least substantially squircular transverse cross-sectional shape, and/or an at least partially squircular transverse cross-sectional shape. As yet another example, central opening 36 may have a square transverse cross-sectional shape, an at least substantially square transverse cross-sectional shape, and/or an at least partially square transverse cross-sectional shape.

Central opening 36 may have and/or define any suitable transverse cross-sectional area. As examples, the transverse cross-sectional area of central opening 36 may be at least 0.1 square meters, at least 0.15 square meters; at least 0.2 square meters, at least 0.25 square meters, at least 0.3 square meters, at least 0.4 square meters, at least 0.5 square meters, at most 4 square meters, at most 3 square meters, at most 2 square meters, at most 1 square meter, and/or at most 0.5 square meters.

As illustrated in dashed lines in FIG. 1 and in solid lines in FIGS. 4-5, 7, 17, and 19-21, frame 30 may have and/or define a shield 90. Shield 90, when present, may be shaped, sized, adapted, and/or configured to be received within buried tubular conduit 12, as illustrated in FIGS. 1 and 19-21. Shield 90 may center frame 30 within buried tubular conduit 12 and/or may restrict entry of debris into a frame-tubular gap between buried tubular 10 and frame 30, such as resulting from adjustment of the relative orientation between the buried tubular and height-adjustable fixture 20, as illustrated in FIG. 21 at 94 and discussed herein. Shield 90 also may be referred to herein as a grout ring 90 and/or as a mud ring 90.

As also illustrated in dashed lines in FIG. 1, fixtures 20 may include and/or may be associated with a clamp 130. Clamp 130, when present, may be configured to be retained on jack screw 120 via a corresponding nut 134 and/or to operatively interlock frame 30 with buried tubular 10. As an example, an included angle 132 of clamp 130 may be less than 90 degrees. As such, and upon tightening of nut 134, a free end 136 of clamp 130 may press against an inner surface of buried tubular 10, thereby operatively interlocking fixture 20 with the buried tubular. Examples of included angle 132 include angles at most 88 degrees, at most 86 degrees, at most 84 degrees, at most 82 degrees, at most 80 degrees, at most 78 degrees, at most 76 degrees, at most 74 degrees, at most 72 degrees, at most 70 degrees, at least 60 degrees, at least 65 degrees, at least 70 degrees, at least 75 degrees, and/or at least 80 degrees. Clamp 130 also may be referred to herein as a wedge clamp 130, a compression clamp 130, and/or an anti-lift clamp 130.

Slot nuts 100 may include and/or be any suitable structure that is shaped and/or sized to be received within slots 50 of frame 30, that is shaped and/or sized to be positioned within slots 50 while frame 30 is supported by buried tubular 10, and/or that is adapted, configured, designed, and/or constructed to receive jack screws 120, as illustrated in FIGS. 1, 15-18, and 21. Additionally or alternatively, slot nuts 100 may include any suitable structure that is adapted, configured, designed, and/or constructed to permit and/or facilitate adjustment of the relative orientation between buried tubular 10 and height-adjustable fixture 20.

As discussed, each slot nut 100 may be configured to be inserted into corresponding slot 50 along insertion trajectory 52. Insertion trajectory 52 may be parallel, or at least substantially parallel, to lower frame surface 34 and/or may be perpendicular, or at least substantially perpendicular, to an opening axis 38 of central opening 36, as illustrated in FIG. 1.

When received within slots 50, slot nuts 100 are adapted, configured, and/or shaped to interlock with flange 40 and/or to resist separation from flange 40 along any separation trajectory (i.e., direction) that is not parallel, or at least substantially parallel, to insertion trajectory 52. Stated another way, slots 50 and slot nuts 100 together are configured such that slot nuts 100 only can be positioned within slots 50 and/or removed from slots 50 by sliding slot nuts 100, relative to frame 30, along insertion trajectory 52 of each slot 50.

As illustrated in dashed lines in FIG. 1 and in solid lines in FIGS. 8-9, 12-14, and 18, each slot nut 100 may have and/or define a corresponding jack-screw-accepting threaded region 114. Jack-screw-accepting threaded region 114 is configured to threadingly engage with a corresponding jack screw 120, as illustrated in FIGS. 1, 15-18, and 21. Height-adjustable fixtures 20 may include a plurality of jack screws 120. In such a configuration, each jack screw 120 may be threadingly engaged with the corresponding jack-screw-accepting threaded region 114 of the corresponding slot nut 100.

Jack-screw-accepting threaded region 114 may threadingly engage with jack screws 120 in any suitable manner. As an example, jack-screw-accepting threaded region 114 may define a female thread, while jacks screws 120 may define a corresponding male thread. Examples of the female thread and/or of the male thread include an Acme thread, a trapezoidal thread, a coil thread, a round thread, a ⅝"-8TPI Acme thread, a ⅝"-8TPI trapezoidal thread, a ⅝"-8TPI coil thread, and/or a ⅝"-8TPI round thread.

As illustrated in dashed lines in FIG. 1 and in solid lines in FIGS. 15-18 and 21, and as discussed, fixtures 20 may include and/or may be utilized with jack screw 120. As also discussed, jack screws 120, when present, may be shaped and/or sized to threadingly engage with slot nuts 100 and/or with jack-screw-accepting threaded regions 114 thereof. In some examples, jack screws 120 may include and/or be metallic jack screws 120.

In some examples, jack screws 120, or a region of jack screws 120 that projects from an upper nut surface 102 of slot nuts 100, may be configured to selectively fracture and/or break, such as responsive to being hit by a hammer. Such jack screws, which may be referred to herein as fracturing jack screws, may be formed from a brittle material, from a polymeric material, from a plastic, and/or from aluminum. Utilization of fracturing jack screws may decrease, or eliminate, a need to separate the jack screws from a remainder of the fixture subsequent to adjustment of the height and/or level of the fixture.

Turning to FIGS. 1 and 15-21, which illustrate frames 30 in combination with slot nuts 100, frame 30 and/or slot nuts 100 may be configured such that lower nut surface 106 of slot nuts 100 is not coplanar with lower frame surface 34 of frame 30. Stated another way, and as perhaps best illustrated in FIGS. 1 and 18, gap 112 may separate lower nut surface 106 from lower frame surface 34. Stated yet another way, lower nut surface 106 may be recessed and/or elevated within and/or may extend within corresponding slot 50. Stated another way, lower nut surface 106 may be positioned between upper frame surface 32 and lower frame surface 34 and/or may be proximate the upper frame surface relative to the lower frame surface. Stated yet another way, a plane that is defined by lower nut surface 106 may be spaced-apart from a plane that is defined by lower frame surface 34 by at least a threshold clearance spacing, such as may be defined by gap 112. Examples of the threshold clearance spacing include spacings of at least 0.2 millimeters (mm), at least 0.4 mm, at least 0.6 mm, at least 0.8 mm, at least 1 mm, at least 1.5 mm, at least 2 mm, at least 2.5 mm, at most 5 mm, at most 4 mm, at most 3 mm, at most 2 mm, and/or at most 1 mm.

As discussed, the gap and/or the threshold clearance spacing may permit and/or facilitate insertion of slot nuts 100 into corresponding slots 50 while frame 30 is supported by and/or positioned on upper tubular surface 16 of buried tubular 10. Stated another way, slot nuts 100 may be free to be received within corresponding slot 50 and/or to translate along corresponding insertion trajectory 52 without operative engagement between the slot nuts, or lower nut surface 106 of the slot nuts, and the buried tubular and/or the upper tubular surface thereof.

In some examples, slots nuts 100 may have and/or define lower nut surface 106, upper nut surface 102, and a neck region 110, as perhaps best illustrated in FIGS. 1, 8-11, 14, and 17-18. Neck region 110 may be positioned between lower nut surface 106 and upper nut surface 102, and slot nuts 100 may taper, or become smaller in transverse cross-sectional area, from lower nut surface 106 toward neck region 110 and/or may taper, or become smaller in transverse cross-sectional area, from upper nut surface 102 toward neck region 110. Additionally or alternatively, neck region 110 may define a neck region transverse cross-sectional area that is less than a surface area of lower nut surface 106 and/or that is less than a surface area of upper nut surface 102. As such, and as perhaps best illustrated in FIG. 18, a region of frame 30 that defines slot 50 may extend into and/or toward neck region 110 when slot nut 100 is received within slot 50.

Neck region 110 may have and/or define any suitable transverse cross-sectional shape. As examples, the neck region may have and/or define a noncircular, a square, an at least partially square, a rectangular, an at least partially rectangular, a squircular, and/or an at least partially squircular transverse cross-sectional shape. Such a configuration may facilitate insertion of slot nuts 100 into slots 50, and, at the same time, cause slot nuts 100 to resist rotation relative to slots 50 once received therein.

As discussed, a shape of slots 50 may correspond to a shape of slot nuts 100, such as to permit and/or facilitate receipt of slot nuts 100 into slots 50 and/or to cause slot nuts 100 to resist motion relative to frame 30 along any direction and/or trajectory that is not parallel to insertion trajectory 52 once the slot nuts are inserted within corresponding slots 50. As an example, and as illustrated in FIG. 18, slot nuts 100 may taper from lower nut surface 106 toward neck region 110. As also illustrated in FIG. 18, slots 50 may taper from lower frame surface 34. A shape, or an angle, of the taper of slots 50 may correspond to, or match, a shape, or an angle, of the taper of slot nuts 100. Such a configuration may cause slot nuts 100 to resist motion, relative to frame 30, in a vertically upward direction and/or toward upper frame surface 32 once the slot nuts are received within corresponding slots 50.

As another example, and as shown in FIG. 18, upper nut surface 102 may project away, or radially away, from neck region 110. Such a configuration may cause slot nuts 100 to resist motion, relative to frame 30, in a vertically downward direction and/or away from upper frame surface 32 once the slot nuts are received within slots 50.

With continued reference to FIG. 18, slot nuts 100 may be shaped such that, when slot nuts 100 are received within slots 50, neck region 110 is vertically above an upper flange surface 42 of flange 40 and/or such that a lower tapered region 108 of each of the slot nuts, which tapers from lower nut surface 106 toward neck region 110, is operatively engaged with flange 40. Such a configuration may provide additional clearance between slot nuts 100 and flange 40 during insertion of slot nuts 100 into slots 50.

FIG. 22 is a flowchart illustrating examples of methods 200 of adjusting height-adjustable fixtures, according to the present disclosure. Examples of the height-adjustable fixtures are disclosed herein with reference to height-adjustable fixtures 20. Methods 22 include inserting a slot nut at 210 and rotating a jack screw at 220. Methods 200 also may include placing a clamp at 230, breaking off a region of the jack screw at 240, and/or repeating at least a subset of the methods at 250. Methods 200 further may include filling a space at 260.

Inserting the slot nut at 210 may include inserting at least one slot nut of a plurality of slot nuts into and/or within a corresponding slot of a plurality of slots of a frame of the height-adjustable fixture. Examples of the frame are disclosed herein with reference to frame 30. Examples of the corresponding slot are disclosed herein with reference to slot 50. Examples of the at least one slot nut are disclosed herein with reference to slot nuts 100.

In some examples, the inserting at 210 may be performed while a lower frame surface of the frame is physically supported by an upper tubular surface of a buried tubular. Examples of the lower frame surface are disclosed herein with reference to lower frame surface 34. Examples of the buried tubular are disclosed herein with reference to buried tubular 10. Examples of the upper tubular surface are disclosed herein with reference to upper tubular surface 16.

The inserting at 210 may be performed in any suitable manner. As an example, the inserting at 210 may include inserting such that the frame is captured between a lower nut surface of the at least one slot nut and an upper nut surface of the at least one slot nut. Examples of the lower nut surface are disclosed herein with reference to lower nut surface 106. Examples of the upper nut surface are disclosed herein with reference to upper nut surface 102.

As another example, the inserting at 210 may include inserting such that the lower nut surface of the at least one slot nut is recessed within the corresponding slot relative to the lower frame surface of the frame. As yet another example, the inserting at 210 may include establishing, forming, and/or defining a gap between the lower nut surface of the at least one slot nut and the upper tubular surface of the buried tubular. Examples of the gap are disclosed herein with reference to gap 112. As another example, the inserting at 210 may include moving, translating, and/or sliding the at least one slot nut along, or only along, an insertion trajectory, which may be parallel, or at least substantially parallel, to a longitudinal axis of the corresponding slot. Examples of the insertion trajectory are disclosed herein with reference to insertion trajectory 52.

The inserting at 210 may be performed with any suitable timing and/or sequence during methods 200. As examples, the inserting at 210 may be performed prior to the rotating at 220, prior to the placing at 230, prior to the breaking at 240, at least partially concurrently with and/or during the repeating at 250, and/or prior to the filling at 260.

Rotating the jack screw at 220 may include rotating a corresponding jack screw, which is received within a corresponding jack-screw-accepting threaded region of the at least one slot nut. Additionally or alternatively, the rotating at 220 may include rotating such that the corresponding jack screw engages with the buried tubular and/or such that the corresponding jack screw adjusts, or provides a motive force for adjustment of, an orientation of the height-adjustable fixture relative to the buried tubular. Examples of the corresponding jack screw are disclosed herein with reference to jack screws 120.

The rotating at 220 may be performed with any suitable timing and/or sequence during methods 200. As examples, the rotating at 220 may be performed subsequent to the inserting at 210, prior to and/or at least partially concurrently with the placing at 230, prior to the breaking at 240, at least partially concurrently with and/or during the repeating at 250, and/or prior to the filling at 260.

Placing the clamp at 230 may include placing the clamp at least partially within a central opening of the frame. Examples of the clamp are disclosed herein with reference to clamp 130. Examples of the central opening are disclosed herein with reference to central opening 36. Additionally or alternatively, the placing at 230 may include placing such that the clamp operatively interlocks the frame with the buried tubular. In some examples, the placing at 230 may include threading a nut onto the corresponding jack screw to urge the clamp against both the frame and the buried tubular. Examples of the nut are disclosed herein with reference to nut 134.

The placing at 230 may be performed with any suitable timing and/or sequence during methods 200. As examples, the placing at 230 may be performed subsequent to the inserting at 210, subsequent to the rotating at 220, prior to the breaking at 240, at least partially concurrently with and/or during the repeating at 250, and/or prior to the filling at 260.

Breaking off the region of the jack screw at 240 may include breaking off a region of the jack screw that projects from the upper nut surface of the at least one slot nut. The breaking at 240 may permit and/or facilitate utilization of the adjustable fixture without a need to remove the jack screw subsequent to adjustment. Additionally or alternatively, the breaking at 240 may decrease a potential for inadvertent and/or undesired adjustment of the adjustable fixture. The breaking at 240 is illustrated in FIG. 21 and indicated at 122.

The breaking at 240 may be performed with any suitable timing and/or sequence during methods 200. As examples, the breaking at 240 may be performed subsequent to the inserting at 210, subsequent to the rotating at 220, subsequent to the placing at 230, at least partially concurrently with and/or during the repeating at 250, and/or prior to, subsequent to, and/or during the filling at 260.

Repeating at least the subset of the methods at 250 may include repeating any suitable step and/or steps of methods 200 in any suitable order and/or in any suitable manner. As an example, the at least one slot nut may include and/or be a first slot nut. Similarly, the corresponding jack screw may include and/or be a first corresponding jack screw. In some such examples, the repeating at 250 may include repeating at least the inserting at 210 with a second slot nut and repeating the rotating at 220 with a second corresponding jack screw, such as to perform an additional adjustment of the adjustable fixture.

In some examples of methods 200, and subsequent to the rotating at 220 and/or to the repeating at 250, a space may extend between the lower frame surface and the upper tubular surface. In some such examples, methods 200 further may include filling the space at 260. The filling at 260 may include filling the space with a material, such as cement and/or grout. The filling at 260 may provide further support for the adjustable fixture, may be utilized to "lock in" a desired adjustment of the adjustable fixture, and/or may be utilized to decrease a potential for entry of debris into a tubular conduit of the adjustable fixture via the space.

The filling at 260 may be performed with any suitable timing and/or sequence during methods 200. As examples, the filling at 260 may be performed subsequent to the inserting at 210, subsequent to the rotating at 220, subsequent to the placing at 230, subsequent to the breaking at 240, and/or subsequent to the repeating at 250.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

Illustrative, non-exclusive examples of height-adjustable fixtures and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A height-adjustable fixture for a buried tubular, the fixture comprising:

a frame having an upper frame surface, a lower frame surface, a flange that defines a plurality of slots, and a central opening that extends between the upper frame surface and the lower frame surface and is sized to provide access to a buried tubular conduit that is defined by the buried tubular; and a plurality of slot nuts, wherein each slot nut of the plurality of slot nuts is shaped to be received within a corresponding slot of the plurality of slots.

A2. The fixture of paragraph A1, wherein each slot nut of the plurality of slots nuts is configured to be inserted into the corresponding slot of the plurality of slots along an insertion trajectory that is at least one of parallel, or at least substantially parallel, to the lower frame surface and perpendicular, or at least substantially perpendicular, to an opening axis of the central opening.

A3. The fixture of paragraph A2, wherein each slot nut of the plurality of slot nuts, when received within the corresponding slot of the plurality of slots, is configured to interlock with the flange and to resist separation from the flange along any separation trajectory that is not parallel to an insertion trajectory.

A4. The fixture of any of paragraphs A1-A3, wherein each slot nut of the plurality of slot nuts includes a corresponding jack-screw-accepting threaded region configured to threadingly engage with a corresponding jack screw.

A5. The fixture of paragraph A4, wherein the fixture further includes a plurality of jack screws, wherein each corresponding jack screw is threadingly engaged with the corresponding jack-screw-accepting threaded region.

A6. The fixture of any of paragraphs A1-A5, wherein the frame includes, and optionally is, at least one of a metallic frame, a cast iron frame, a plastic frame, and an aluminum frame.

A7. The fixture of any of paragraphs A1-A6, wherein the frame is defined by at least one of a monolithic frame body and a unitary frame body.

A8. The fixture of any of paragraphs A1-A7, wherein the central opening is a cylindrical, or an at least substantially cylindrical, central opening.

A9. The fixture of any of paragraphs A1-A8, wherein the central opening defines a transverse cross-sectional area of at least one of:

at least 0.1 square meters, at least 0.15 square meters; at least 0.2 square meters, at least 0.25 square meters, at least 0.3 square meters, at least 0.4 square meters, or at least 0.5 square meters; and (ii) at most 4 square meters, at most 3 square meters, at least 2 square meters, at most 1 square meter, or at most 0.5 square meters.

A10. The fixture of any of paragraphs A1-A9, wherein the flange extends parallel, or at least substantially parallel, to the lower frame surface.

A11. The fixture of any of paragraphs A1-A10, wherein the flange at least partially defines the lower frame surface.

A12. The fixture of any of paragraphs A1-A11, wherein the flange extends away from the central opening.

A13. The fixture of any of paragraphs A1-A12, wherein the flange at least one of:

(i) at least partially defines the central opening; and (ii) extends into the central opening.

A14. The fixture of any of paragraphs A1-A13, wherein the frame further includes a rim that at least partially defines the upper frame surface.

A15. The fixture of any of paragraphs A1-A14, wherein the rim extends perpendicular, or at least substantially perpendicular, to the flange.

A16. The fixture of any of paragraphs A1-A15, wherein the frame further includes a support lip configured to support a cover.

A17. The fixture of any of paragraphs A1-A16, wherein the fixture further includes a/the cover configured to selectively restrict access to the central opening, optionally from an upper frame surface-facing side of the height-adjustable fixture.

A18. The fixture of any of paragraphs A1-A17, wherein each slot of the plurality of slots extends radially from a central point.

A19. The fixture of any of paragraphs A1-A18, wherein each slot of the plurality of slots extends away from the central opening.

A20. The fixture of any of paragraphs A1-A18, wherein each slot of the plurality of slots extends into the central opening.

A21. The fixture of any of paragraphs A1-A20, wherein each slot nut defines a lower nut surface, and further wherein, at least one of:

when each slot nut is received within the corresponding slot, the lower nut surface is recessed within the corresponding slot relative to the lower frame surface of the frame;

(ii) when each slot nut is received within the corresponding slot, the lower nut surface is proximate the upper frame surface relative to the lower frame surface;

(iii) when each slot nut is received within the corresponding slot, the lower nut surface extends within the corresponding slot; and (iv) when each slot nut is received within the corresponding slot, a plane that is defined by the lower nut surface is spaced apart from a plane that is defined by the lower frame surface by at least a threshold clearance spacing.

A22. The fixture of any of paragraphs A1-A21, wherein, the plurality of slot nuts is configured to provide at least the threshold clearance spacing from the lower frame surface such that, when the lower frame surface is supported by the buried tubular, each slot nut is free to be received within the corresponding slot without operative engagement between each slot nut and the buried tubular.

A23. The fixture of any of paragraphs A1-A22, wherein each slot nut defines a/the lower nut surface, an upper nut surface, and a neck region positioned between the lower nut surface and the upper nut surface.

A24. The fixture of paragraph A23, wherein, when each slot nut is received within the corresponding slot, a region of the frame that defines the corresponding slot extends into the neck region.

A25. The fixture of any of paragraphs A23-A24, wherein the neck region defines a neck region transverse cross-sectional area that is less than a surface area of the lower nut surface and that is also less than a surface area of the upper nut surface.

A26. The fixture of any of paragraphs A23-A25, wherein the neck region defines at least one of a noncircular, a square, an at least partially square, a rectangular, an at least partially rectangular, a squircular, and an at least partially squircular transverse cross-sectional shape.

A27. The fixture of any of paragraphs A23-A26, wherein each slot nut tapers from the lower nut surface to the neck region and also from the upper nut surface to the neck region.

A28. The fixture of any of paragraphs A23-A27, wherein a longitudinal cross-sectional shape of each slot of the plurality of slots corresponds to a longitudinal cross-sectional shape of each slot nut of the plurality of slot nuts.

A29. The fixture of any of paragraphs A1-A28, wherein the fixture further includes a clamp configured to operatively interlock the frame with the buried tubular.

A30. The fixture of paragraph A29, wherein the fixture further includes a nut configured to retain the clamp on a/the corresponding jack screw.

A31. The fixture of any of paragraphs A29-A30, wherein the clamp defines an included angle, wherein the included angle is at least one of:

(i) at most 88 degrees, at most 86 degrees, at most 84 degrees, at most 82 degrees, at most 80 degrees, at most 78 degrees, at most 76 degrees, at most 74 degrees, at most 72 degrees, or at most 70 degrees; and (ii) at least 60 degrees, at least 65 degrees, at least 70 degrees, at least 75 degrees, or at least 80 degrees.

A32. The fixture of any of paragraphs A1-A32, wherein the fixture includes the buried tubular, wherein the frame is positioned on an upper tubular surface of the buried tubular such that the lower frame surface of the frame faces toward the upper tubular surface of the buried tubular.

B1. A method of adjusting the height-adjustable fixture of any of paragraphs A1-A32, the method comprising:

while the lower frame surface is physically supported by an/the upper tubular surface of the buried tubular, inserting at least one slot nut of the plurality of slot nuts within the corresponding slot of the plurality of slots; and subsequent to the inserting, rotating a/the corresponding jack screw, which is received within a/the corresponding jack-screw-accepting threaded region of the at least one slot nut of the plurality of slot nuts, such that the corresponding jack screw engages the buried tubular and adjusts an orientation of the height-adjustable fixture relative to the buried tubular.

B2. The method of paragraph B1, wherein the inserting the at least one slot nut includes establishing a gap between a/the lower nut surface of the at least one slot nut and the upper tubular surface of the buried tubular.

B3. The method of any of paragraphs B1-B2, wherein the inserting includes inserting such that a/the lower nut surface of the at least one slot nut is recessed within the corresponding slot relative to the lower frame surface of the frame.

B4. The method of any of paragraphs B1-B3, wherein the method further includes placing a/the clamp at least partially within the central opening of the frame such that the clamp operatively interlocks the frame with the buried tubular.

B5. The method of any of paragraphs B1-B4, wherein the inserting the at least one slot nut includes inserting such that the frame is captured between a/the lower nut surface and a/the upper nut surface of the at least one slot nut.

B6. The method of any of paragraphs B1-B5, wherein, subsequent to the rotating, the method further includes breaking off a region of the jack screw that projects from an/the upper nut surface of the at least one slot nut.

B7. The method of any of paragraphs B1-B6, wherein the at least one slot nut is a first slot nut, wherein the corresponding jack screw is a first corresponding jack screw, and further wherein the methods include repeating the inserting to insert a second slot nut and repeating the rotating with a second corresponding jack screw.

B8. The method of any of paragraphs B1-B7, wherein, subsequent to the rotating, a space extends between the lower frame surface and the upper tubular surface, and further wherein the method includes at least partially filling the space, optionally with at least one of cement and grout.

C1. The use of any of the height-adjustable fixtures of any of paragraphs A1-A32 with any of the methods of any of paragraphs B1-B8.

C2. The use of any of the methods of any of paragraphs B1-B8 with any of the height-adjustable fixtures of any of paragraphs A1-A32.

C3. The use of a slot nut to adjust an orientation of a height-adjustable fixture.

INDUSTRIAL APPLICABILITY

The fixtures and methods disclosed herein are applicable to the construction and roadway/greenway appurtenances industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A height-adjustable fixture for a buried tubular, the fixture comprising:

a frame having an upper frame surface, a lower frame surface, a flange that defines a plurality of slots, and a central opening that extends between the upper frame surface and the lower frame surface and is sized to provide access to a buried tubular conduit that is defined by the buried tubular; and a plurality of slot nuts, wherein each slot nut of the plurality of slot nuts is shaped to be received within a corresponding slot of the plurality of slots, wherein each slot nut defines a lower nut surface, an upper nut surface, and a neck region positioned between the lower nut surface and the upper nut surface, wherein the neck region defines a neck region transverse cross-sectional area that is less than a surface area of the lower nut surface and that also is less than a surface area of the upper nut surface, wherein, when each slot nut is received within the corresponding slot, a region of the frame that defines the corresponding slot extends into the neck region, and further wherein each slot nut tapers from the lower nut surface to the neck region and also from the upper nut surface to the neck region.

2. The fixture of claim 1, wherein the neck region defines at least one of a noncircular, a square, an at least partially square, a rectangular, an at least partially rectangular, a squircular, and an at least partially squircular transverse cross-sectional shape.

3. The fixture of claim 1, wherein a longitudinal cross-sectional shape of each slot of the plurality of slots corresponds to a longitudinal cross-sectional shape of the plurality of slot nuts.

4. The fixture of claim 1, wherein each slot nut of the plurality of slot nuts is configured to be inserted into the corresponding slot of the plurality of slots along an insertion trajectory that is at least one of at least substantially parallel to the lower frame surface and at least substantially perpendicular to an opening axis of the central opening.

5. The fixture of claim 4, wherein each slot nut of the plurality of slot nuts, when received within the corresponding slot of the plurality of slots, is configured to interlock with the flange and to resist separation from the flange along any separation trajectory that is not parallel to the insertion trajectory.

6. The fixture of claim 1, wherein each slot nut of the plurality of slot nuts includes a corresponding jack-screw-accepting threaded region configured to threadingly engage with a corresponding jack screw, wherein the fixture further includes a plurality of jack screws, and further wherein each corresponding jack screw of the plurality of jack screws is threadingly engaged with a corresponding jack-screw-accepting threaded region of a plurality of jack-screw-accepting threaded regions.

7. The fixture of claim 1, wherein the flange at least partially defines the lower frame surface.

8. The fixture of claim 1, wherein the flange extends away from the central opening.

9. The fixture of claim 1, wherein the flange extends into the central opening.

10. The fixture of claim 1, wherein the frame further includes a rim that at least partially defines the upper frame surface, and further wherein the rim extends at least substantially perpendicular to the flange.

11. The fixture of claim 1, wherein the frame further includes a support lip configured to support a cover.

12. The fixture of claim 11, wherein the fixture further includes the cover, wherein the cover is configured to selectively restrict access to the central opening.

13. The fixture of claim 1, wherein each slot of the plurality of slots extends away from the central opening.

14. The fixture of claim 1, wherein each slot of the plurality of slots extends into the central opening.

15. The fixture of claim 1, wherein each slot nut defines the lower nut surface, and further wherein, when each slot nut is received within the corresponding slot, at least one of:

(i) the lower nut surface is recessed within the corresponding slot relative to the lower frame surface of the frame;

(ii) the lower nut surface is proximate the upper frame surface relative to the lower frame surface;

(iii) the lower nut surface extends within the corresponding slot; and (iv) a plane that is defined by the lower nut surface is spaced apart from a plane that is defined by the lower frame surface by an at least a threshold clearance spacing.

16. The fixture of claim 1, wherein the fixture further includes a clamp configured to operatively interlock the frame with the buried tubular.

17. A method of adjusting a height-adjustable fixture for a buried tubular, wherein the fixture includes a frame having an upper frame surface, a lower frame surface, a flange that defines a plurality of slots, and a central opening that extends between the upper frame surface and the lower frame surface and is sized to provide access to a buried tubular conduit that is defined by the buried tubular, and a plurality of slot nuts, wherein each slot nut of the plurality of slot nuts is shaped to be received within a corresponding slot of the plurality of slots, wherein each slot nut defines a lower nut surface, an upper nut surface, and a neck region positioned between the lower nut surface and the upper nut surface, wherein, when each slot nut is received within the corresponding slot, a region of the frame that defines the corresponding slot extends into the neck region, and further wherein each slot nut tapers from the lower nut surface to the neck region and also from the upper nut surface to the neck region, the method comprising:

while the lower frame surface is physically supported by an upper tubular surface of the buried tubular, positioning at least one slot nut of the plurality of slot nuts within the corresponding slot of the plurality of slots; and subsequent to the positioning, rotating a corresponding jack screw, which is received within a corresponding jack-screw-accepting threaded region of the at least one slot nut of the plurality of slot nuts, such that the corresponding jack screw engages the buried tubular and adjusts an orientation of the height-adjustable fixture relative to the buried tubular.

18. The method of claim 17, wherein the positioning the at least one slot nut includes establishing a gap between the lower nut surface of the at least one slot nut and the upper tubular surface of the buried tubular.

19. A method of adjusting a height-adjustable fixture for a buried tubular, wherein the fixture includes a frame having an upper frame surface, a lower frame surface, a flange that defines a plurality of slots, and a central opening that extends between the upper frame surface and the lower frame surface and is sized to provide access to a buried tubular conduit that is defined by the buried tubular, and a plurality of slot nuts, wherein each slot nut of the plurality of slot nuts is shaped to be received within a corresponding slot of the plurality of slots, wherein each slot nut defines a lower nut surface, and further wherein, when each slot nut is received within the corresponding slot, the lower nut surface is recessed within the corresponding slot relative to the lower frame surface of the frame, the method comprising:

while the lower frame surface is physically supported by an upper tubular surface of the buried tubular, positioning at least one slot nut of the plurality of slot nuts within the corresponding slot of the plurality of slots; and subsequent to the positioning, rotating a corresponding jack screw, which is received within a corresponding jack-screw-accepting threaded region of the at least one slot nut of the plurality of slot nuts, such that the corresponding jack screw engages the buried tubular and adjusts an orientation of the height-adjustable fixture relative to the buried tubular.

20. The method claim 19, wherein, the plurality of slot nuts is configured to provide at least a threshold clearance spacing from the lower frame surface such that, when the lower frame surface is supported by the buried tubular, each slot nut is free to be received within the corresponding slot without operative engagement between each slot nut and the buried tubular.

21. The method of claim 19, wherein the positioning the at least one slot nut includes establishing a gap between the lower nut surface of the at least one slot nut and the upper tubular surface of the buried tubular.

22. A height-adjustable fixture for a buried tubular, the fixture comprising:

a frame having an upper frame surface, a lower frame surface, a flange that defines a plurality of slots, a central opening that extends between the upper frame surface and the lower frame surface and is sized to provide access to a buried tubular conduit that is defined by the buried tubular, and a rim that at least partially defines the upper frame surface, wherein the rim extends at least substantially perpendicular to the flange; and a plurality of slot nuts, wherein each slot nut of the plurality of slot nuts is shaped to be received within a corresponding slot of the plurality of slots, wherein each slot nut defines a lower nut surface, an upper nut surface, and a neck region positioned between the lower nut surface and the upper nut surface, wherein, when each slot nut is received within the corresponding slot, a region of the frame that defines the corresponding slot extends into the neck region, and further wherein each slot nut tapers from the lower nut surface to the neck region and also from the upper nut surface to the neck region.

23. The fixture of claim 22, wherein the frame further includes a support lip configured to support a cover.

24. The fixture of claim 23, wherein the fixture further includes the cover, wherein the cover is configured to selectively restrict access to the central opening.

25. The fixture of claim 22, wherein the fixture further includes a clamp configured to operatively interlock the frame with the buried tubular.

26. A height-adjustable fixture for a buried tubular, the fixture comprising:

a frame having an upper frame surface, a lower frame surface, a flange that defines a plurality of slots, a central opening that extends between the upper frame surface and the lower frame surface and is sized to provide access to a buried tubular conduit that is defined by the buried tubular, and a support lip configured to support a cover; and a plurality of slot nuts, wherein each slot nut of the plurality of slot nuts is shaped to be received within a corresponding slot of the plurality of slots, wherein each slot nut defines a lower nut surface, an upper nut surface, and a neck region positioned between the lower nut surface and the upper nut surface, wherein, when each slot nut is received within the corresponding slot, a region of the frame that defines the corresponding slot extends into the neck region, and further wherein each slot nut tapers from the lower nut surface to the neck region and also from the upper nut surface to the neck region.

27. The fixture of claim 26, wherein the fixture further includes the cover, wherein the cover is configured to selectively restrict access to the central opening.

28. The fixture of claim 26, wherein the fixture further includes a clamp configured to operatively interlock the frame with the buried tubular.

29. A height-adjustable fixture for a buried tubular, the fixture comprising:

a frame having an upper frame surface, a lower frame surface, a flange that defines a plurality of slots, and a central opening that extends between the upper frame surface and the lower frame surface and is sized to provide access to a buried tubular conduit that is defined by the buried tubular;

a plurality of slot nuts, wherein each slot nut of the plurality of slot nuts is shaped to be received within a corresponding slot of the plurality of slots, wherein each slot nut defines a lower nut surface, an upper nut surface, and a neck region positioned between the lower nut surface and the upper nut surface, wherein, when each slot nut is received within the corresponding slot, a region of the frame that defines the corresponding slot extends into the neck region, and further wherein each slot nut tapers from the lower nut surface to the neck region and also from the upper nut surface to the neck region; and a clamp configured to operatively interlock the frame with the buried tubular.

* * * * *